United States Patent [19]

Davis et al.

[11] Patent Number: 4,850,127

[45] Date of Patent: Jul. 25, 1989

[54] GUN STOCK INCORPORATING MAGAZINE

[75] Inventors: William A. Davis, Sacramento; Lannis P. Ballard, Rancho Cordova, both of Calif.

[73] Assignee: Speedfeed, Inc., West Sacramento, Calif.

[21] Appl. No.: 869,387

[22] Filed: May 29, 1986 (Under 37 CFR 1.47)

Related U.S. Application Data

[63] Continuation-in-part of Ser. No. 577,645, Feb. 6, 1984, Pat. No. 286,669.

[51] Int. Cl.[4] ..... F41C 23/00

[52] U.S. Cl. ..... 42/71.01

[58] Field of Search ..... 42/49.01, 71.01, 72, 42/6

[56] References Cited

U.S. PATENT DOCUMENTS

D. 286,669 11/1986 Ballard et al. ..... D22/108

1,099,992 6/1914 Micke ..... 42/6

1,517,420 12/1924 Fritz ..... 42/71.01

1,734,852 11/1929 Frampton et al. ..... 42/71.01

2,375,106 5/1945 Holcomb ..... 42/71.01

FOREIGN PATENT DOCUMENTS 3408637 9/1985 Fed. Rep. of Germany ..... 42/71.01

*Primary Examiner*—Deborah L. Kyle

*Assistant Examiner*—Richard W. Wendtland

*Attorney, Agent, or Firm*—Limbach, Limbach & Sutton

[57] ABSTRACT

A gun stock which incorporates a magazine for ammunition storage having a buttstock portion which includes at least one magazine having at least one magazine and port are configured to releasably retain at least one round of ammunition. Included within the magazine is a means for temporarily maintaining the round of ammunition in retained position. An inclined ramped surface is provided, in a preferred embodiment, to facilitate manual insertion and removal of ammunition from the magazine port.

9 Claims, 1 Drawing Sheet

GUN STOCK INCORPORATING MAGAZINE

RELATED APPLICATION DATA

This application is a continuation-in-part of copending application Ser. No. 577,645 filed Feb. 6, 1984, now U.S. Pat. No. Des. 286,669, issued Nov. 11, 1986 and assigned to a common assignee.

TECHNICAL FIELD

This invention relates to a gun stock incorporating a magazine for ammunition storage and more particularly to a magazine designed to facilitate delivery of stored ammunition into the user's hand.

BACKGROUND ART

Many firearms are available which incorporate a magazine capable of feeding ammunition directly into the chamber of the weapon. Among these are found firearms with detachable magazines and firearms with integral magazines. Firearms with detachable magazines provide the capability of rapidly reloading or changing to a different type of ammunition. See, e.g., U.S. Pat. No. 4,115,943.

Firearm weapons with integral magazines generally require that the magazine be reloaded one round at a time once the initial store of ammunition is exhausted. Alternatively, single rounds are fed directly into the receiver by hand in order to maintain continuous firing. Typical of weapons with integral magazines is the pump shotgun whose magazine, due to the size of the shotgun shell, cannot accommodate large amounts of spare ammunition. In situations where numerous rounds must be fired, the user of the weapon often carries spare rounds in pouches or contained in ammunition belts. However, it is sometimes desirable to reduce the delay between the expenditure of the final round of ammunition contained in the integral magazine and the transfer of secondarily stored ammunition into the chamber. Under these circumstances, optimally, the reserve shells are presented at the shortest distance from the receiver and in proper orientation to be inserted. It is also considered desirable to enable this operation to be performed with one hand, while retaining the other hand in position ready for firing the weapon.

Furthermore, it is sometimes desirable for the user of the weapon to carry it unloaded while providing the capability of rapid chamber loading.

It is also considered desirable to provide rapid access to different types of ammunition which can be utilized in the same firearm, so that the appropriate choice can be made as the target is presented.

In order to provide the above benefits, while retaining the simplicity of an ordinary gun stock, it is desirable to minimize the number of additional parts and to avoid the use of accessory features which must be employed to store the ammunition.

Numerous ammunition storage devices are known which fail to provide the features outlined above. Among these are U.S. Pat. Nos. 746,859; 1,099,992; 1,517,420; 1,526,847; 2,476,355; 2,495,977 and 3,638,344.

Accordingly, it is an object of the present invention to provide an ammunition storage magazine which provides rapid access to stored ammunition.

It is also an object of the present invention to provide a magazine which allows the user to insert and remove ammunition with one hand.

It is a further object of the present invention to provide an ammunition storage magazine which requires few moving parts.

It is a still further object of the present invention to provide an ammunition storage magazine which allows ready differentiation between different types of stored ammunition.

DISCLOSURE OF THE INVENTION

The obtainment of these and other objects of the invention is provided by a gun stock which incorporates a magazine for ammunition storage comprising an elongate buttstock portion with forward and rearward ends, having at least one magazine intermediate these ends. The magazine will contain at least one magazine port which, together with the magazine, are configured to releasably retain at least one round of ammunition and deliver that round at the magazine forward end.

BRIEF DESCRIPTION OF THE DRAWINGS

The above-recited and additional objects and features of the present invention will be understood from the following detailed description of representative embodiments, as illustrated in the accompanying drawings, in which.

BEST MODE FOR CARRYING OUT THE INVENTION

Figure 1:
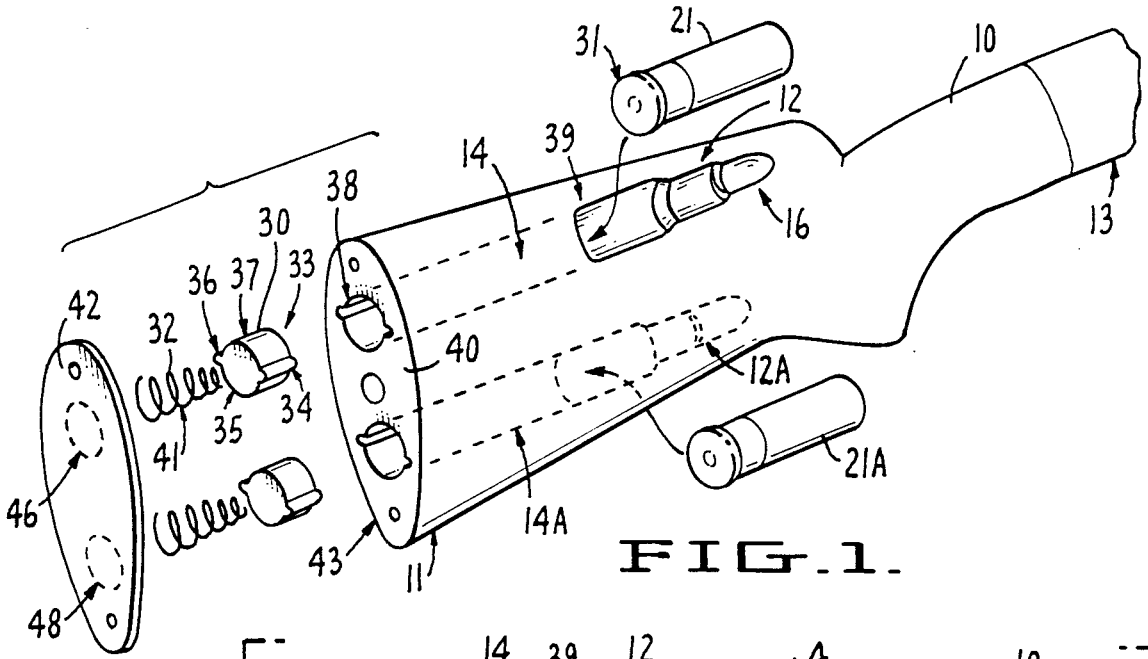
FIG. 1 is an exploded perspective view, with portions broken away, of a gun stock embodying the magazine of the present invention, together with shells positioned so as to depict their insertion therein.

This invention provides a gun stock which incorporates a magazine for ammunition storage which is capable of attaining the above-recited objects, as well as objects not herein disclosed, by incorporating the novel features hereinafter described.

While the invention is illustrated primarily with an embodiment adapted for use with shotguns, the novel features of the present invention as seen to have broader application. It should be apparent that the present invention is adaptable to numerous types of weapons and its utility is not limited to those of a particular class.

Furthermore, the present invention can be employed in gun stocks used to store blanks or training loads, or with weapons which are incapable of firing live ammunition.

The gun stock will be described in detail by reference to the drawings, in which FIG. 1 displays a shotgun stock 10 which includes a buttstock 11, which in turn incorporates magazine ports 12 and 12A and magazines 14 and 14A extending rearwardly within the buttstock. Although not shown in the drawings and not considered a part of the present invention, it will be clear the forward portion of the gun stock 13 will be adapted to attach to a selected shotgun receiver and barrel. In addition, although most shotguns are designed to utilize a separate forestock, which can function to "pump" ammunition from the integral magazine into the chamber, the benefits of the present invention are retained in a gun stock which incorporates a forestock as an integral portion thereof.

Taking a single magazine as representative and not limiting, the extended cylindrical region 14 of each magazine, when seen in cross-section, may generally conform to the cross-section of the contained ammunition. It will be recognized that magazine cross-section shapes other than circular are possible, although less desirable.

Figure 5:
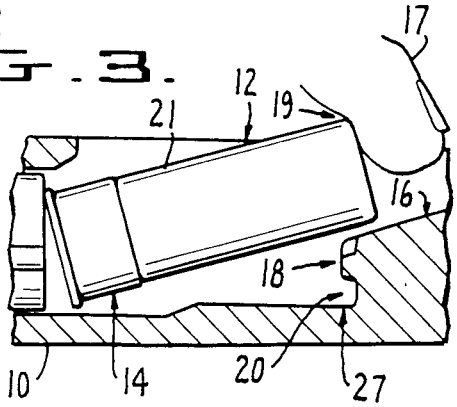
FIG. 5 is an enlarged view of a portion of FIG. 4, showing one mode of operation of the present invention.

As shown in greater detail in FIG. 5, the forward end of the magazine region 14 and magazine port 12 are configured to provide for slidable insertion and selectively releasable retension of stored ammunition. Beginning at the forward edge of the magazine 14 and port 12, a ramped surface finger groove 16 is provided to allow ready access by the user's finger 17 to the forward end 19 of the stored ammunition. Although not essential, it is considered desirable to provide a relatively wide cross-section for the finger groove 16, in order to accommodate the user's finger when gloves are worn in cold weather. It will be readily understood that the precise angle formed between the ramp surface of the groove 16 and the centerline of the magazine 14 is not essential, although it is desirable to provide a relatively oblique angle, ranging between approximately 120 and 160 degrees, to simplify access to the ammunition. The ramp surface of groove 16 is inclined upward, toward the forward end of magazine 14.

With respect to that feature of the present invention known as the temporary maintaining means, at the rearward edge of the finger groove 16, the invention provides a projection member 18 which interlocks with a forward portion 19 of the stored ammunition. The forward end of the ammunition is biased against the projection member 18 with a follower member 30 and spring 32 which urge the ammunition in a forward direction. It will be readily appreciated that the shape and size of the projection member 18 can vary substantially without departing from the spirit and scope of the present invention.

Figure 4:
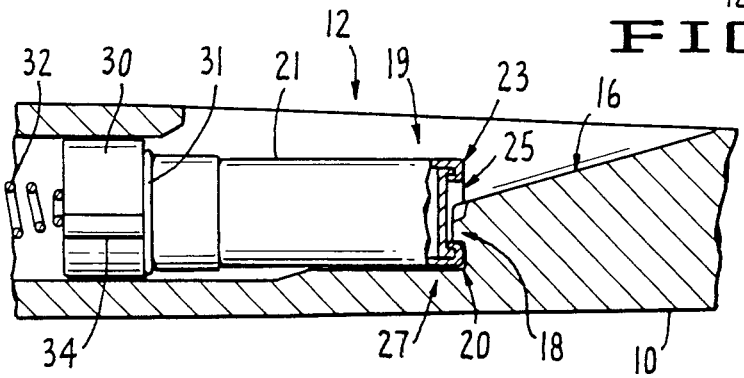
FIG. 4 is an enlarged view of a portion of FIG. 2 taken generally in verticle cross-section along line 4—4, with an inserted round of ammunition shown with portions broken away.

In the presently preferred embodiment as shown in FIG. 4, the invention provides for retaining shotgun shell 21, in the gun stock magazine. The shells are typically provided with a forward end 19 having a circumferential rim 23 and slightly recessed nose 25. As depicted in FIG. 4, when the shell is in interlocked position, the rim 23 will abutt the recessed region 20 formed by the wall of the magazine 27 and the projection member 18. However, it will be readily appreciated that, with other classes of firearms and stored ammunition, slight modifications of this design feature will preserve the benefits inherent in the present invention.

As disclosed in FIG. 1, the magazine 14 can extend rearwardly through the buttstock portion of the gun stock. A portion of the magazine, referred to as the port 12, provides communication between the magazine and the exterior of the gun stock. In one embodiment, the port 12 extends substantially along the entire length of the magazine, which can be designed to retain a single round of ammunition in a substantially exposed condition. However, in a presently preferred embodiment, the magazine extends rearwardly to provide for the storage of a plurality of rounds of ammunition.

As described above, one feature of the present invention is provided by a means for temporarily maintaining a round of ammunition in retained position in the magazine. In a presently preferred embodiment, in which a shotgun stock is provided with a magazine extending into the buttstock to provide for the storage of at least two shotgun shells, spring pressure is provided from the rearward portion of the magazine in order to bias the shell 21 forward against the projection member 18. An additional benefit of this pressure is the increased speed at which a round of ammunition is ejected upon demand by the user.

As portrayed in greater detail in FIG. 1, this spring-driven bias is desirably provided by a follower member 30 which is placed between a spring 32 and the rearward portion 31 of one round of ammunition. The spring 32 has a rearward end 41 which impacts upon a plate 42, at the rearward end of the buttstock 11. The follower member 30 can be constructed of molded plastic and designed to conform generally to the cross-section of the magazine. Where the magazine chamber has a generally cylindrical cross-section, the follower member 30 will likewise be generally cylindrical. The forward end 33 of the follower member 30 will, during the operation of the present invention, contact the rearward surface 31 of at least one shell and transmit a force to urge the forward most shell in the magazine against the projection member 18.

While the presently preferred embodiment is described with reference to a coiled spring, it will be understood by those skilled in the art that the spring biasing means of the present invention can include hydraulically operated cylinders or other techniques known in the art to provide a forward-biasing force.

Additional benefits are obtained by providing indexing projections 34 and 36 on the outer surface 37 of the follower member 30. Each projection 36 is designed to fit into a complimentary groove 38 and 40 provided in the wall of the magazine. It is considered desirable that these grooves 38, 40 terminate in a region rearward of the magazine port 39, so as to provide positive retension of the follower member 30 when the magazine is completely unloaded. It will be readily appreciated that the shapes of the projections 34 and 36 are not an essential feature of the invention and any shape capable of indexing are intended to be within the scope of the invention. They should generally conform to the shape and positioning of the complimentary grooves 38, 40 in order to provide ease of operation during the insertion or release of stored ammunition.

Figure 2:
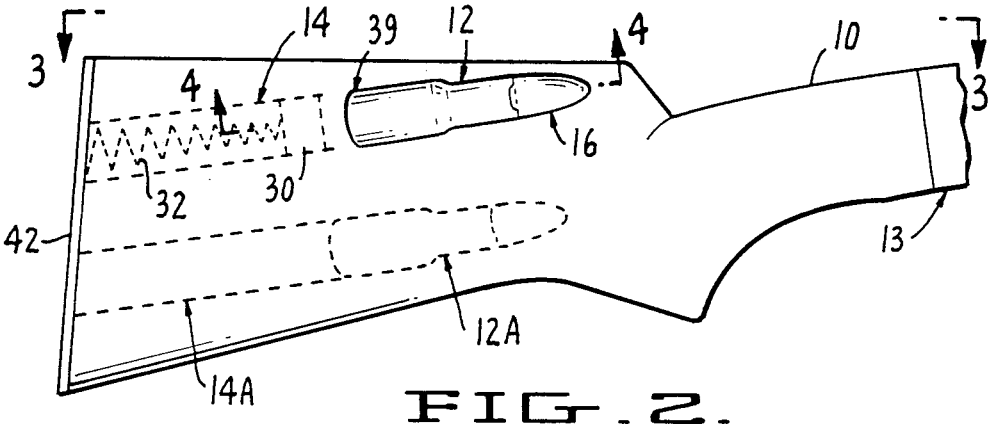
FIG. 2 is a side elevational view of the assembled gun stock of FIG. 1 with certain portions deleted and certain features shown in phantom line.

The spring 32 should be selected to provide sufficient pressure in its extended position so as to actively eject the shell 21 being removed through the magazine port. Ideally, sufficient spring pressure will remain at the end of the travel so that the final shell removed from the magazine will continue to receive spring-driven biasing force against the projection member 18. It is also considered desirable to select a spring rate which does not result in excessive resistance to the insertion of ammunition as the magazine is filled. It has been found that a spring rate of approximately $2.5 \pm 0.5$ lbs/inch is desirable although it would be clear that a wide range of spring rates would continue to function in the present invention. It is also considered desirable, although not essential, to provide a spring 32 which incorporates a decreasing radius, such as shown in FIGS. 2 and 5, so that the spring coils can nest within one another, thus minimizing the spring's longitudinal dimension in its fully compressed state while maximizing the ammunition storage capacity. In a preferred embodiment, AS-5 music wire is used to form a spring having 16.5 coils.

It is also considered desirable that the rearward end 35 of the follower member 30 provides a recessed region capable of accepting the forward end of the spring 32. This provides a means to minimize the amount of the magazine chamber 14 occupied by the follower member 30 and spring 32 when the magazine is fully loaded with ammunition.

During compression the rearward end 41 of the spring 32 will bear against the rearmost boundary of the magazine chamber. A presently preferred embodiment provides the rear boundary of the magazine as a removable plate 42 which is attached to the rearmost portion of the buttstock 43, after insertion of the follower member 30 and spring 32. This plate can be separate from, or incorporated into, an elastomeric cushioning recoil pad which is conventionally provided for most gun stocks. The plate 42 can also desirably incorporate recessed regions 46 and 48 which approximate the cross-section of each magazine chamber 14 and 14A. Recessed regions 46 and 48 are located in plate 42 so as to further extend magazines 14 and 14A when plate 42 is attached to the rear portion 43 of the buttstock 11. These recesses provide a further region for the spring 32 to occupy when compressed, thus maximizing the space in the magazine available for storage of ammunition. The recesses 46 and 48 also provide for ease in assembly of the gun stock by retaining the rearward end 41 of the spring 32 as the plate 42 is applied during manufacture.

While the spring 32 and follower member 30 represent a presently preferred embodiment for urging the shell 21 against the projection member 18, it will be recognized that other means exist in the art for providing such biasing pressure, such as hydraulic or pneumatic devices. By appropriate design, such a device can be provided which will apply approximately the same biasing pressure without respect to the amount of ammunition stored in the magazine.

Figure 3:
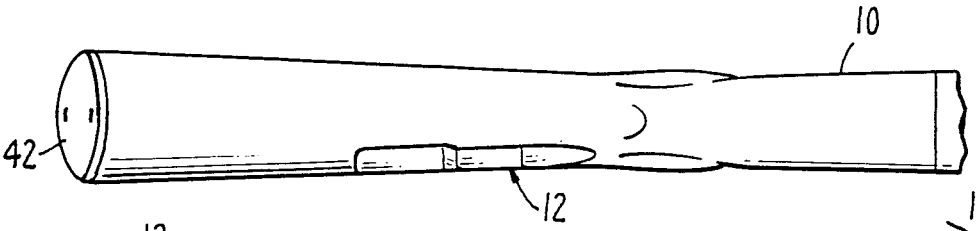
FIG. 3 is a top plan view, taken along line 3—3 of FIG. 2.

A presently preferred embodiment of the invention, as illustrated in FIGS. 1 and 2, provides two magazine chambers and magazine ports, for example, stacked vertically in the buttstock portion of the gun stock. As shown in FIG. 2, these plural magazines 14 and 14A can be provided with magazine ports 12 and 12A on opposite sides of the gun stock. In this mode, the gun stock of the present invention will provide ready access to the stored ammunition for both right-handed and left-handed users. As shown in FIG. 2 and FIG. 3, one presently preferred embodiment provides magazine port 12 for access to the upper magazine 14 on the right-hand side of the gun stock and magazine port 12A for access to the lower magazine 14A on the left-hand side of the stock. This design choice was selected to facilitate operation by a right-handed user. While this mode is presently preferred, it is clear that the magazine ports 12 and 12A can be provided on the same side of the gun stock while retaining the benefits of the present invention.

It will also be clear that in certain embodiments the invention can provide a plurality of storage magazines, each designed to store a lesser amount of ammunition and located in various places on the gun stock.

In those embodiments of the present invention where the magazine and magazine port are designed to retain a single round of ammunition, the means for maintaining the ammunition in retained position can be simplified from that shown in FIG. 1 and described above. For example, the rearmost portion of the magazine can be provided with a elastomeric plug, such as rubber, or a simple leaf or coil spring which will bias the shell 21 against the projection member 18. Furthermore, while less desirable, it will be clear that the magazine can be designed so that its dimensions approximate those of a shotgun shell and the resilience of the forward rim 23 of the shell 21 can be used to advantage in inserting the shell against the resistance offered by the projection member 18. In this embodiment, the means for maintaining the ammunition in retained position can be provided by the resilience of the rim 23 without resort to the additional features described above for urging the nose 25 of the shell 21 against the projection member 18. However, care must be taken to avoid deforming the shell 21 upon insertion or removal from the magazine.

While the preferred embodiment has been described with reference to shotgun shells, it will be under stood by those skilled in the art that the present invention can be conveniently adapted for use with ammunition members of different shapes. In recognizing this modification, which is intended to be within the scope of the appended claims, the projection member 18 will have to be designed to accommodate the forward end of the differently shaped ammunition. For example, in the case of the typical pointed-nosed bullet, a suitable receiving cavity must be provided to temporarily maintain the ammunition in the retained position.

Although the foregoing invention has been described in some detail by way of illustration and example for purposes of clarity of understanding, it will be obvious to those skilled in the art that certain changes and modifications may be practiced within the scope of the appended claims.

We claim:

1. A gun stock which incorporates a magazine for ammunition storage comprising a stock which is adapted to be attached to a gun having a receiver for ammunition and having an elongate buttstock portion with forward and rearward ends;

at least one elongate magazine, intermediate said buttstock ends and capable of releasably retaining at least one round of elongate ammunition, having forward and rearward ends, so that the longitudinal axis of said retained ammunition is generally in alignment with the longitudinal axis of said magazine;

at least one uncovered magazine port in said buttstock at the magazine forward end, which port opens directly to the exterior of the buttstock; and means for temporarily maintaining at least one ammunition round in retained position with the front end proximate to the magazine port comprising retention means comprising at least one projection member which contacts a portion of the forward end of the round of ammunition adjacent to the magazine port, and means for longitudinally and releasably biasing the ammunition round in contact with said retention means, thereby maintaining said ammunition round in a temporary retention relationship.

2. A gun stock as recited in claim 1 wherein the stock is adapted to be attached to a shotgun and at least one magazine is provided with a generally circular cross-section so as to provide telescopic engagement with ammunition adapted for insertion into the receiver of the shotgun.

3. A gun stock as recited in claim 1 wherein said magazine port further comprises a ramp portion inclined upward towards said buttstock forward end, thereby providing access to the ammunition round retained proximate to the magazine port.

4. A gun stock as recited in claim 1 wherein said biasing means comprises a spring-driven follower for contacting said ammunition rearward end and biasing the ammunition against said projection member.

5. A gun stock as recited in claim 1 wherein said magazine is disposed generally in alignment with said buttstock longitudinal axis, whereby the ammunition can be removed from the magazine while remaining approximately oriented for insertion into the receiver.

6. A gun stock as recited in claim 5 wherein said magazine extends rearwardly from said port into said stock to accommodate a plurality of ammunition rounds.

7. A gun stock which incorporates a magazine for ammunition storage comprising a stock which is adapted to be attached to a shotgun having a receiver for accepting shotgun ammunition and having an elongate buttstock portion with forward and rearward ends;

at least one elongate magazine, intermediate said buttstock ends and disposed generally in alignment with said buttstock longitudinal axis, said magazine capable of releasably retaining at least one round of elongate shotgun ammunition so that the longitudinal axis of said ammunition is generally in alignment with the longitudinal axis of said magazine;

at least one uncovered magazine port located at the magazine forward end which opens directly to the exterior of the buttstock; and means for temporarily maintaining at least one shotgun ammunition round in the retained position in the magazine and proximate to the magazine port comprising retention means comprising at least one projection member which contacts a portion of the forward end of the round of ammunition adjacent to the magazine port, and means for longitudinally and releasably biasing the ammunition round in contact with said retention means, thereby maintaining said ammunition round in a temporary retention relationship.

8. A gun stock as recited in claim 7 wherein said biasing means comprises a spring-driven follower for contacting said ammunition round rearward end and biasing the ammunition against said projection member.

9. A gun stock as recited in claim 7 wherein said magazine port further comprises a ramp portion inclined upward towards said buttstock forward end, thereby providing access to the ammunition retained proximate the magazine port.

* * * * *

UNITED STATES PATENT AND TRADEMARK OFFICE

CERTIFICATE OF CORRECTION

PATENT NO. : 4,850,127

DATED : July 25, 1989

INVENTOR(S): William A. Davis, et al.

It is certified that error appears in the above - identified patent and that said Letters Patent is hereby corrected as shown below:

In line 4 of the Abstract, after "zine" and before "and" insert --port at the forward end of the magazine, which magazine--

Signed and Sealed this

Fifteenth Day of May, 1990

*Attest:*

HARRY F. MANBECK, JR.

*Attesting Officer*

*Commissioner of Patents and Trademarks*